US008159318B2

(12) United States Patent
Yang et al.

(10) Patent No.: US 8,159,318 B2
(45) Date of Patent: Apr. 17, 2012

(54) ELECTROMAGNET ASSEMBLY DIRECTLY DRIVING LATCH OF AN ELECTRONIC CIRCUIT BREAKER

(75) Inventors: Guang Yang, Duluth, GA (US); John Quentin Cowans, Decatur, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 57 days.

(21) Appl. No.: 12/560,562

(22) Filed: Sep. 16, 2009

(65) Prior Publication Data

US 2010/0073113 A1 Mar. 25, 2010

Related U.S. Application Data

(60) Provisional application No. 61/098,845, filed on Sep. 22, 2008.

(51) Int. Cl.
*H01H 75/00* (2006.01)
*H01H 73/02* (2006.01)

(52) U.S. Cl. ..... 335/6; 335/18; 335/21; 335/35; 335/38

(58) Field of Classification Search ..... 335/6, 18, 335/202, 21, 35, 38
See application file for complete search history.

(56) References Cited

U.S. PATENT DOCUMENTS 6,307,453 B1 * 10/2001 Wellner et al. ..... 335/6

* cited by examiner

*Primary Examiner* — Ramon Barrera

(57) ABSTRACT

A circuit breaker includes a trip unit and an electronic fault detection unit sharing a common trip latch for causing the circuit breaker to trip upon detection of a fault by either unit. The circuit breaker has an electromagnet for causing the circuit breaker to trip upon detection of a fault by an electronic fault detection unit. The electromagnet is oriented in the housing proximal the trip latch without any components interposed between them, and directly attracts the latch. Advantageously the electromagnet orientation does not impact operation or the range of motion of the latch or other trip unit components. Advantageously the circuit breaker of the present invention does not increase the trip latch mass, its bulk swept volume through its range of motion or require additional linkage components that potentially might increase trip cycle time. In some embodiments the electromagnet core is reciprocable.

18 Claims, 13 Drawing Sheets

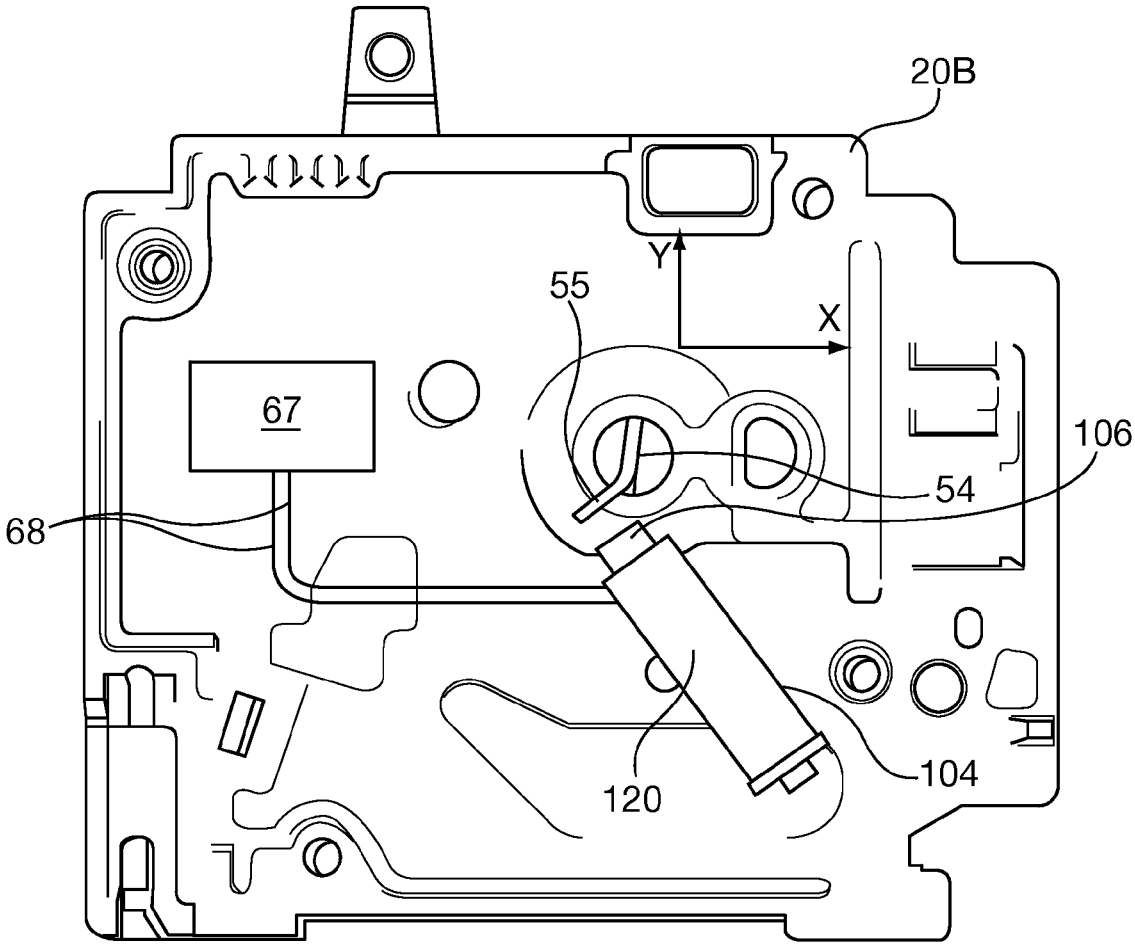
FIG. 11
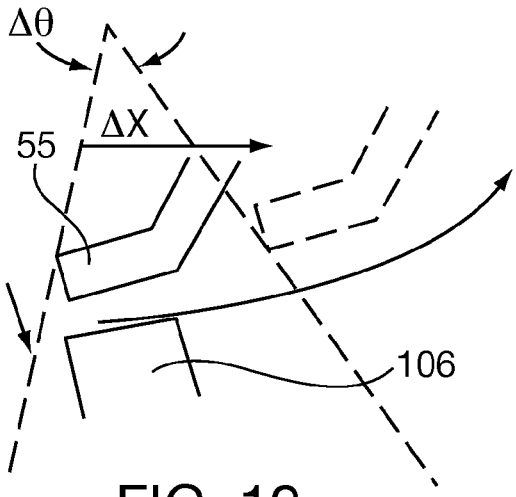
FIG. 12
FIG. 13
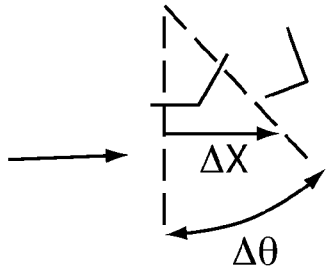

ELECTROMAGNET ASSEMBLY DIRECTLY DRIVING LATCH OF AN ELECTRONIC CIRCUIT BREAKER

CLAIM TO PRIORITY

This application claims the benefit of co-pending U.S. provisional patent application entitled "Electromagnet Assembly Directly Driving Latch of an Electronic Circuit Breaker" filed Sep. 22, 2008 and assigned Ser. No. 61/098,845, which is incorporated by reference herein.

BACKGROUND OF THE DISCLOSURE

1. Field of the Invention

The invention relates to circuit breaker circuit protection devices for electrical distribution systems. More particularly the present invention is directed to latch mechanisms for tripping the operating mechanism of a circuit breaker in response to an actual fault detection made by either a thermal-magnetic electromechanical or electronic trip unit (or other electronic monitoring device) that operate independently within a circuit breaker. Alternatively the operating mechanism may be tripped in response to simulated fault detection in the distribution system.

2. Description of the Prior Art

Circuit breakers are utilized in electrical distribution systems to interrupt power current flow upon detection of a potential fault in the system. Generally circuit breakers are interposed in a power distribution circuit between a line source of power and a downstream circuit load. A circuit breaker commonly includes one or more fixed and moving separable contact pairs that open and close the power distribution circuit. A trip unit (often thermal-magnetic electromechanical, analog electronic, digital electronic or combination) monitors circuit load and causes an operating mechanism to separate the contact pair (open the circuit) upon detection of a fault condition. Examples of distribution system faults include short circuit or thermal overheating overloads, ground faults and arc faults.

Circuit breakers incorporating both a thermal-magnetic electromechanical overload detection trip unit and an electronic fault interruption unit that operate independently within the circuit breaker are sold in the United States of America by Siemens Energy & Automation, Inc. ("Siemens") and other companies. An exemplary Siemens circuit breaker is shown in FIGS. 1-3. The Siemens circuit breaker incorporates a thermal-magnetic electromechanical trip unit for detection of short circuit and over current faults in electric power distribution circuits, and also an independently operating electronic fault interruption unit for detection of arc fault, ground fault or combination of both types of faults. Both the electromechanical trip unit and electronic fault interruption unit need to be able to activate the operating mechanism independently to open the circuit breaker contacts upon fault detection by either respective unit.

As shown in FIG. 1, the circuit breaker 10 is connected to a power source such as the line stab 11 of a power panel by sliding connection with the line terminal 12. A power panel neutral terminal 13 is connected to the circuit breaker panel neutral wire 14. The circuit breaker 10 load power terminal 15 is connected to load circuit power wire 16. Correspondingly, the circuit breaker 10 load neutral terminal 17 is connected to the load circuit neutral wire 18.

The circuit breaker 10 has a multi-component housing 20, including a base 20A, intermediate cover 20B and top cover 20C. The base 20A and intermediate cover 20B form a first compartment. The intermediate cover 20B and top cover 20C in turn form a second compartment. The circuit breaker handle 22 allows an operator to energize and de-energize the electrical distribution circuit, as well as reset the circuit breaker after fault condition trips the circuit breaker. The exemplary Siemens circuit breaker also has an electronic trip indicator light 24 and a test button 26 that is used to simulate a fault and confirm the breaker 10 operating condition. The fault circuit interrupter 27 is shown schematically and is of known design. The circuit breaker housing components 20A, 20B and 20C are held together in tandem by a plurality of rivets 28, one of which is shown.

FIG. 2 shows a schematic plan view of the first compartment of the known Siemens circuit breaker 10, showing exemplary components housed within the base 20A of housing. Note that the intermediate cover 20B is removed in this figure, so that the line terminal 12, fixed contact 30, moving contact 32 and moving contact arm 34 are visible. The operating mechanism 36 includes an engagement sear 42, shown schematically as a dashed line. The operating mechanism 36 selectively opens and closes the circuit breaker contacts and interacts with the trip unit 50 by engagement of the sear 42 with the pivoting latch 52. As is known to those skilled in the art, latch 52 pivots about a pivoting axis A, sweeping a pivotal motion volume. When the engagement sear 42 and latch 52 are engaged the circuit breaker contacts 30, 32 are maintained in the closed position. Conversely, the contacts are open when the latch 52 and engagement sear 42 are disengaged and the circuit breaker 10 does not enable current flow in the power distribution circuit.

The thermal-magnetic trip unit 50 shown in FIG. 2 includes the latch 52 and latch extension tab 54 that projects laterally from the latch swept volume. As those skilled in the art are aware, the trip unit 50 is of the electromechanical thermal-magnetic type including over current bimetal and an armature assembly that generates a magnetic field attractive to the ferrous metal latch 52. A high current flow through the armature assembly (for example caused by a short circuit in the electrical distribution system) creates a sufficiently dense magnetic flux to pivot the latch 52 in a counterclockwise direction to disengage the operating mechanism sear 42.

FIG. 3A shows the known Siemens circuit breaker 10 second compartment intermediate cover 20B, with the top cover 20C removed to show the fault circuit interrupter unit 27. The intermediate cover 20B defines an aperture 66 for passage of the latch extension tab 54 into the second compartment. The fault circuit interrupter unit 27 includes known fault detection electronics 67 (example: arc fault, ground fault or combination of both) shown schematically and solenoid energizing leads 68. The known Siemens circuit breaker shown in FIGS. 1-3 employs a solenoid 70 (see FIG. 3B) having a magnetically conductive metal solenoid housing 72 about which is wound a coil of conductive wire 74 that is connected to the solenoid energizing leads 68. When the solenoid coil 74 is energized the solenoid 70 generates a torroidal magnetic field that expels metal plunger 76 to the right as shown by the arrow B, where it causes counterclockwise rotation of the latch extension tab 54, thereby disengaging the latch 52 from the engagement sear 42 and causing the operating mechanism 36 to separate the circuit breaker contacts 30, 32. Plunger reset spring 78 resets the plunger to its leftward stable position when the solenoid coil 74 is deenergized.

The known Siemens circuit breaker 10 design provides beneficial separation of the fault circuit interrupter electronics 67 from the compartment containing the moving contacts 30, 32, so that arcs created during contact separation are less likely to contaminate the electronics. Use of the solenoid structure 70 on the left side of the extension tab 54 provides for positive pivoting disengagement of the latch 52 from the operating mechanism sear 42 and leaves open the right side of the extension tab. This is beneficial because trip unit 50 disengagement of latch 52 can be more forceful than that caused by the solenoid, so that the latch is caused to pivot with more counterclockwise rotation. Any components within the circuit breaker housing located to the right of the latch 52 should not impede the latch swept volume space occupied during all operational modes.

Despite the known benefits of the Siemens circuit breaker 10, it is desirable to utilize a latch 52 tripping mechanism in the fault circuit interrupter unit 27 that is simpler and less expensive to manufacture than the prior solenoid 70 designs, yet provides for breaker tripping in a manner harmonious and compatible with the trip unit 50 operational modes.

Other known circuit breakers have utilized electromagnets to trip circuit breakers upon detection of ground and arc fault conditions. As shown in FIG. 4, one other circuit breaker 80 utilizes a pivoting latch 82 that is coupled in series with a second hook 84 that pivots about hoop pivot 85. The hook 84 has a downward projecting tab that abuts against the left side of the latch 82. The hook 84 pivots counterclockwise and in turn pivots latch 82 counterclockwise to disengage the latch and corresponding engagement sear (not shown). Hook 84, constructed of ferrous metal, is urged to pivot in a counterclockwise direction by an electromagnet 86 that attracts the hook upon energization of windings 87 about a bobbin having a ferromagnetic core 88. The serially aligned pivoting latch 82 and hook 84 provide sufficient swept volume space for the latch 82 to be disengaged by the circuit breaker 80 trip unit during overcurrent (bimetal heating) or short circuit trip modes without the electromagnet 86 interfering with latch 82 counterclockwise pivoting motion to the right in the figure. However, utilization of the hook 84 adds an additional component to the circuit breaker design. Also, the need to pivot two serially abutting pivots (latch 82 and hook 84) increases system trip response time or the electromagnet current flux force necessary to move the hook 84 more quickly.

Another known latch mechanism employing an electromagnet is shown in FIGS. 5A and 5B. Circuit breaker 90 has a trip unit 91 that occupies a defined volume within the housing during operational modes. The trip unit includes a known bimetal 92 for overcurrent detection that pivots latch 94 counter clockwise out of engagement with an operating mechanism sear (not shown). An electromagnet comprising a steel core 96 and an annular bobbin/winding 98 capturing the steel core therein provide for combined short circuit and electronic fault detection tripping. During short circuit, the steel core 96 through which the electrical distribution system current passes attracts the latch 94, thereby rotating the latch out of engagement with the operating mechanism. When the electronic fault detection unit sends energizing current into the bobbin/winding 98, the electromagnetic attraction of the armature 94 also causes the breaker to trip. Construction of latch 94 is shown more clearly in the cross sectional view of FIG. 5B. The latch 94 has a generally C-shaped cross section when viewed along the pivot radius, so that it essentially wraps around the bimetal 92. The latch 94 C-shaped cross section must be sufficiently deep left to right, so that the bimetal 92 is afforded its full range of operational deformation and it follows that the range of angular pivot motion of the latch 94 must increase in order to travel additional left-to-right clearance distance. This in turn increases the total occupied volume of the trip unit 91 and impacts the attractive magnetic force strength necessary to pivot the latch during short circuit and electronic fault detection unit trip operational modes. First, there being a limited, finite internal volumetric capacity of any circuit breaker housing, any increase of trip unit volume has adverse impact on other component volume. Second, the C-shaped cross section of the latch 94 increases its mass, thus requiring more current in-rush energy in the coil windings 98 during electronic trip operation or in the steel core 96 during short circuit trip operation to generate a greater magnetic attractive force. Third, the larger pivot angular distance that must be traversed by the latch 94 necessarily increases the distance from the attractive magnetic force of the core 96 and electromagnetic coil 98. The increased distance requires generation of a higher intensity magnetic field in order to generate sufficient attractive force between the latch 94 and the magnetic source.

Thus, a need exists in the art for a trip latch actuator that has simpler construction than known solenoid designs, that does not add additional linkage components to move the trip latch, does not add mass to the trip latch, does not increase the circuit breaker case volume occupied by the trip unit and trip latch, and does not interfere with motion of other parallel-functioning thermal-magnetic trip unit components, such as short circuit armatures or bimetal elements.

SUMMARY OF THE INVENTION

Accordingly, an object of the invention is to trip a circuit breaker upon detection of a fault by an electronic fault detection circuit with an electromagnet without interfering with operation of the independent, parallel operating electromechanical trip unit. The present invention is intended to operate without causing one or more of the following, separately or in any sub combination thereof: increasing significantly trip unit latch mass; increasing occupied swept volume of the trip unit components; addition of linkage components that might otherwise increase phase lag response of the trip operation; or interfering with the range of motion of the trip unit components during their modes of operation.

These and other objects are achieved in accordance with the present invention by use of an electromagnet that attracts the latch. The electromagnet structure employs a reciprocating ferromagnetic core oriented proximal the latch, such as proximal a latch extension. Close proximity of the ferromagnetic core and latch enables efficient magnetic attraction of the latch to the electromagnet when the circuit breaker is tripped by the electronic fault detection circuit. However, the reciprocating core can be pushed by the latch or latch extension when the latch is pivoted by the electromechanical trip unit during detection and interruption of overcurrent or short circuit faults. Alternatively, the electromagnet may be constructed with a fixed core. In this alternative embodiment of the present invention, the electromagnet is oriented outside the swept volume of the latch. In another alternative embodiment of the present invention the electromagnet is oriented outside the swept volume of the latch and may be oriented radially tangential to a face of the latch extension. As the latch pivots about its pivot axis, the latch extension face sweeps an arc. The electromagnet is oriented laterally spaced away from the latch extension pivoting arc. In this configuration the electromagnet attracts the latch extension when energized by the electronic fault detection unit. However, when tripped by the electromechanical trip unit, the latch extension pivots laterally past the electromagnet.

The present invention features a circuit breaker including a housing. The housing includes therein a pair of separable contacts for selectively opening and closing an electrical power distribution circuit current flow when the contacts are in respective opened and closed positions. An operating mechanism is coupled to the contacts for selectively opening and closing the contacts. The housing also has therein an overload trip unit, occupying a volume within the housing, for detecting overload conditions in an electrical power distribution circuit. The overload trip unit has a moveable latch, the latch engageable with the operating mechanism, wherein the contacts are maintained in the closed position when the latch is engaged with the operating mechanism and the contacts are open when the latch is disengaged from the operating mechanism. The trip unit disengages the latch upon detection of an overload condition. The housing also includes an electromagnet unit having windings, oriented in the housing proximal the latch, without any components interposed between them. The electromagnet directly attracts the latch and disengages the latch when the windings are energized. A fault interruption unit for detecting fault conditions in an electrical power distribution circuit is also within the housing and electrically coupled to the electromagnet windings. The interruption unit energizes the electromagnet unit upon detection of a fault condition.

The present invention is also directed to a circuit breaker for electrical power distribution circuits, having a housing that includes therein a pair of separable contacts for selectively opening and closing an electrical power distribution circuit current flow when the contacts are in respective opened and closed positions. An operating mechanism is coupled to the contacts for selectively opening and closing the contacts. An overload trip unit for detecting overload conditions in an electrical power distribution circuit is also in the housing, and has a pivotal latch sweeping a pivotal motion volume and a latch extension coupled to the latch projecting outside of the pivotal motion volume. The latch is engageable with the operating mechanism, wherein the contacts are maintained in the closed position when the latch is engaged with the operating mechanism and the contacts are open when the latch is disengaged from the operating mechanism. The trip unit disengages the latch upon detection of an overload condition. The circuit breaker also has an electromagnet unit having windings, oriented in the housing laterally to the latch swept volume proximal the latch extension without any component between them. The electromagnet directly attracts the latch extension and disengages the latch when the windings are energized. The circuit breaker also has a fault interruption unit for detecting fault conditions in an electrical power distribution circuit, electrically coupled to the electromagnet windings. The interruption unit energizes the electromagnet unit upon detection of a fault condition.

The present invention includes a circuit breaker for electrical power distribution circuits having a housing including therein at least a pair of first and second compartments defining an inter-compartment aperture there between. The first compartment includes therein a pair of separable contacts for selectively opening and closing an electrical power distribution circuit current flow when the contacts are in respective opened and closed positions. An operating mechanism is coupled to the contacts for selectively opening and closing the contacts. An overload trip unit for detecting overload conditions in an electrical power distribution circuit is in the first compartment and has a moveable latch and a latch extension coupled to the latch. The latch is engageable with the operating mechanism, wherein the contacts are maintained in the closed position when the latch is engaged with the operating mechanism and the contacts are open when the latch is disengaged from the operating mechanism. The trip unit disengages the latch upon detection of an overload condition. The second compartment includes therein an electromagnet unit having windings, oriented proximal the latch extension. The electromagnet attracts the latch extension and disengages the latch when the windings are energized. A fault interruption unit for detecting fault conditions in an electrical power distribution circuit is electrically coupled to the electromagnet windings. The interruption unit energizes the electromagnet unit upon detection of a fault condition.

The present invention is also directed to a circuit breaker for electrical power distribution circuits having a housing including therein a pair of separable contacts for selectively opening and closing an electrical power distribution circuit current flow when the contacts are in respective opened and closed positions. An operating mechanism is coupled to the contacts for selectively opening and closing the contacts. An overload trip unit for detecting overload conditions in an electrical power distribution circuit is in the housing and has a pivotal latch defining a pivot axis and radius. The latch sweeps a pivotal motion volume. A latch extension is attached to the latch and projects outside of the pivotal motion volume. At least a portion of the latch extension projects generally tangentially to the pivot radius. The latch is engageable with the operating mechanism, wherein the contacts are maintained in the closed position when the latched is engaged with the operating mechanism and the contacts are open when the latch is disengaged from the operating mechanism. The trip unit disengages the latch upon detection of an overload condition. An electromagnet unit having windings is oriented in the housing laterally to the latch swept volume proximal to and laterally spaced away from the tangential portion of the latch extension. The electromagnet directly attracts the tangential portion of the latch extension and disengaging the latch when the windings are energized. A fault interruption unit for detecting fault conditions in an electrical power distribution circuit is electrically coupled to the electromagnet windings. The interruption unit energizes the electromagnet unit upon detection of a fault condition.

BRIEF DESCRIPTION OF THE DRAWINGS

The teachings of the present invention can be readily understood by considering the following detailed description in conjunction with the accompanying drawings, in which:

FIG. 11 is a perspective plan view of another embodiment of the electromagnet and latch extension of the present invention;

FIGS. 12 and 13 are schematic views of the electromagnet and latch extension embodiment of FIG. 11, showing the range of motion of the latch extension during electromagnet induced trip initiated by the electronic fault detector unit and overload trip initiated by the electromechanical trip unit;

To facilitate understanding, identical reference numerals have been used, where possible, to designate identical or substantially similar elements that are common to the figures.

DETAILED DESCRIPTION

After considering the following description, those skilled in the art will clearly realize that the teachings of the present invention can be readily utilized in circuit breaker trip units.

Figure 1:
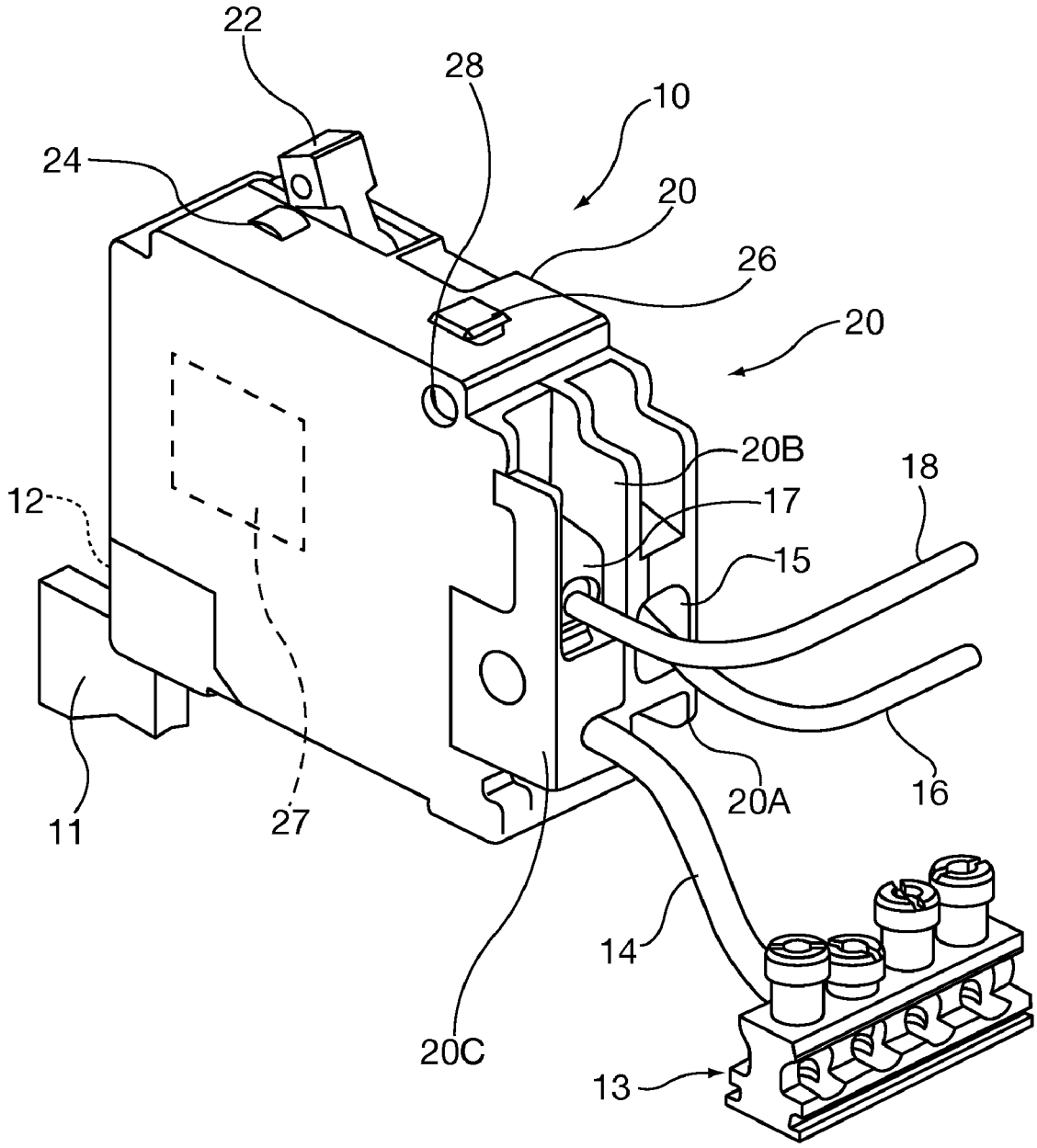
FIG. 1 PRIOR ART
FIG. 1 is a schematic perspective view of a prior art circuit breaker.
Figure 2:
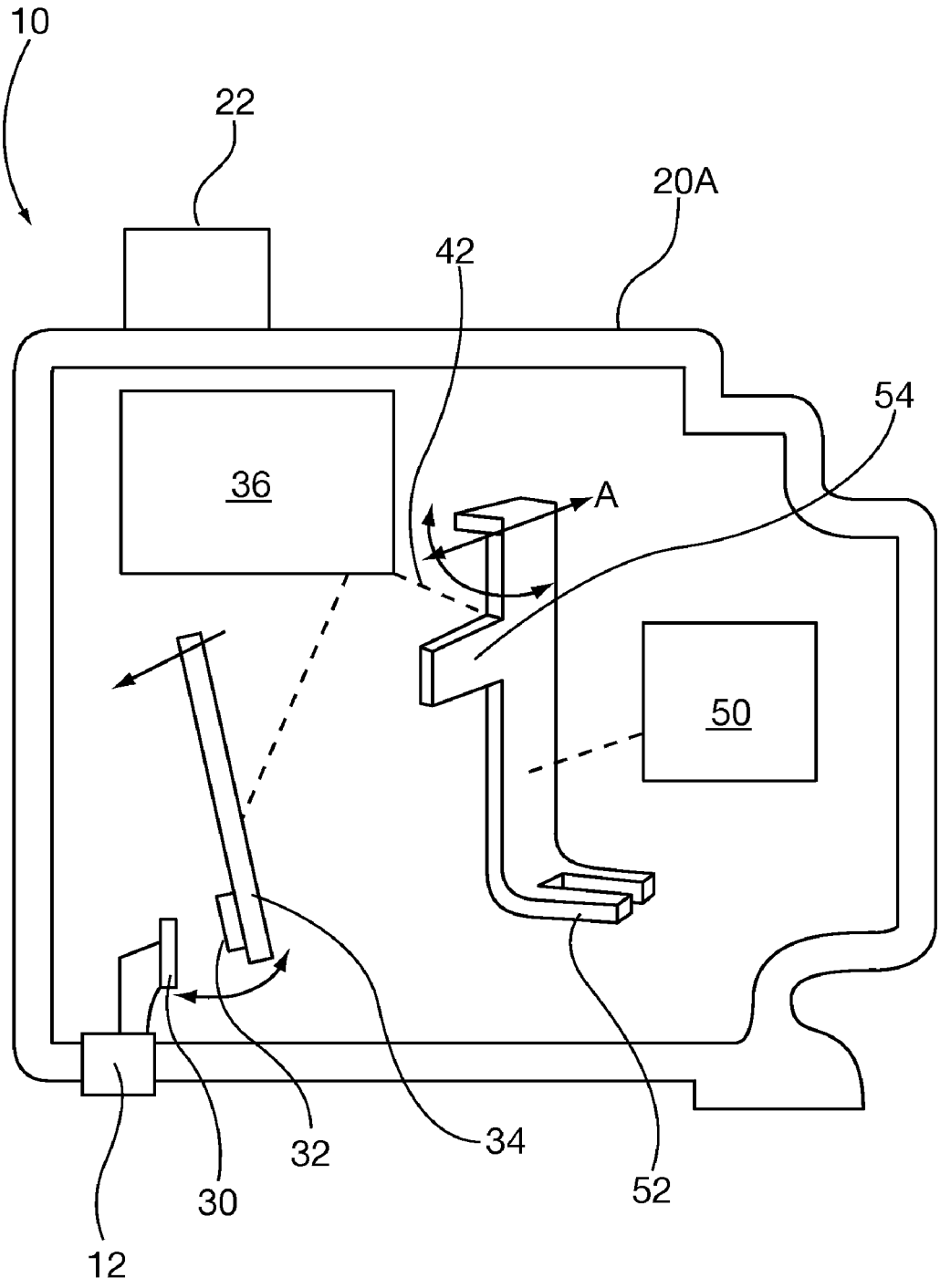
FIG. 2 PRIOR ART
FIG. 2 is a schematic plan view of the prior art circuit breaker of FIG. 1 showing a first compartment of the circuit breaker.
Figure 3A:
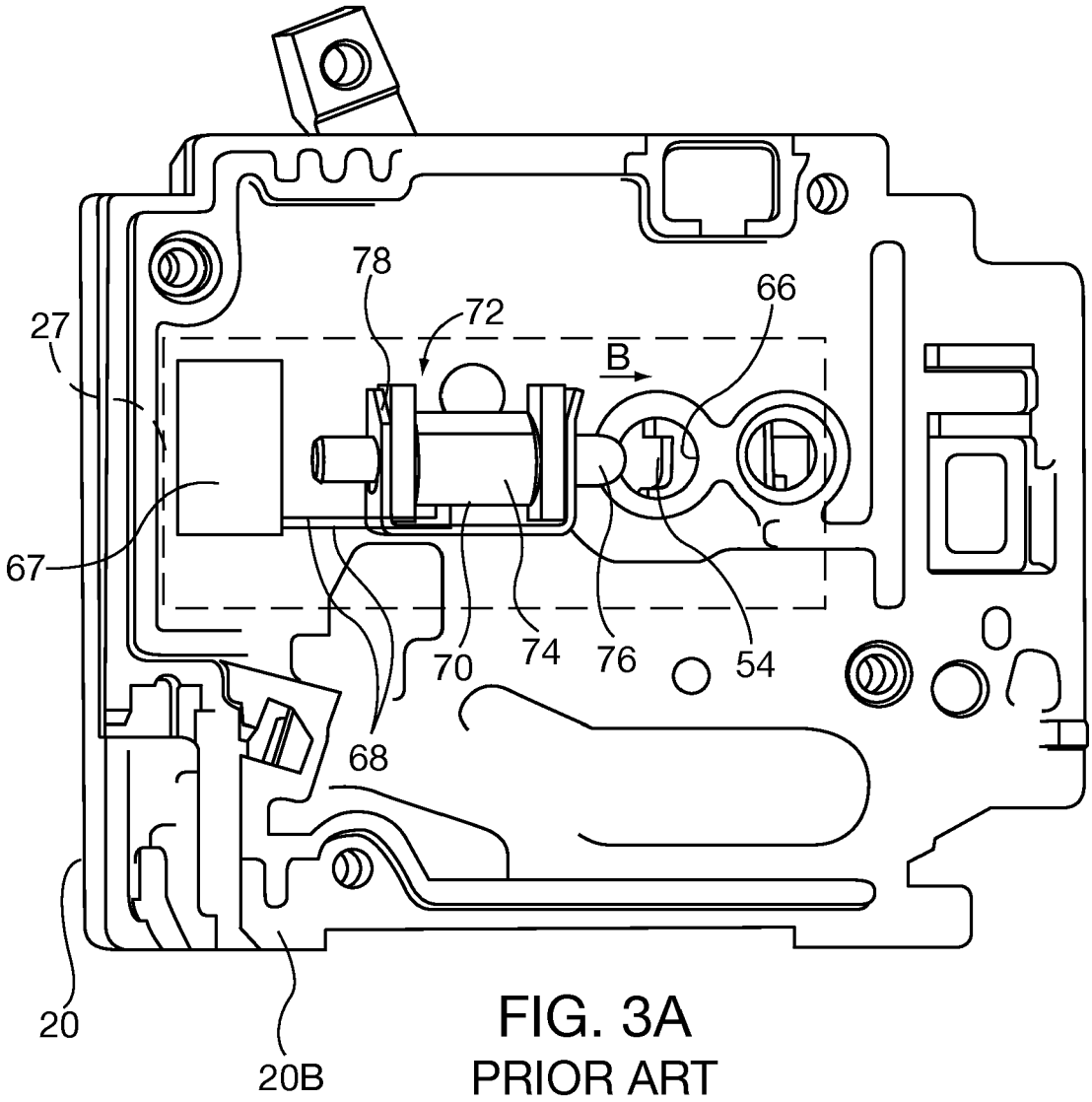
FIG. 3A PRIOR ART
FIGS. 3A and 3B are respectively a schematic plan view of the prior art circuit breaker of FIG. 1 showing a second compartment of the circuit breaker and an axial cross section of a solenoid in that compartment.
Figure 3B:
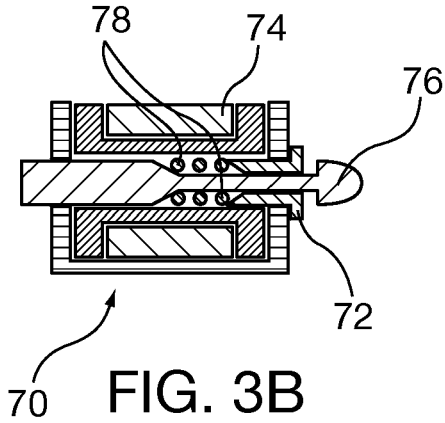
FIG. 3B PRIOR ART
Figure 6:
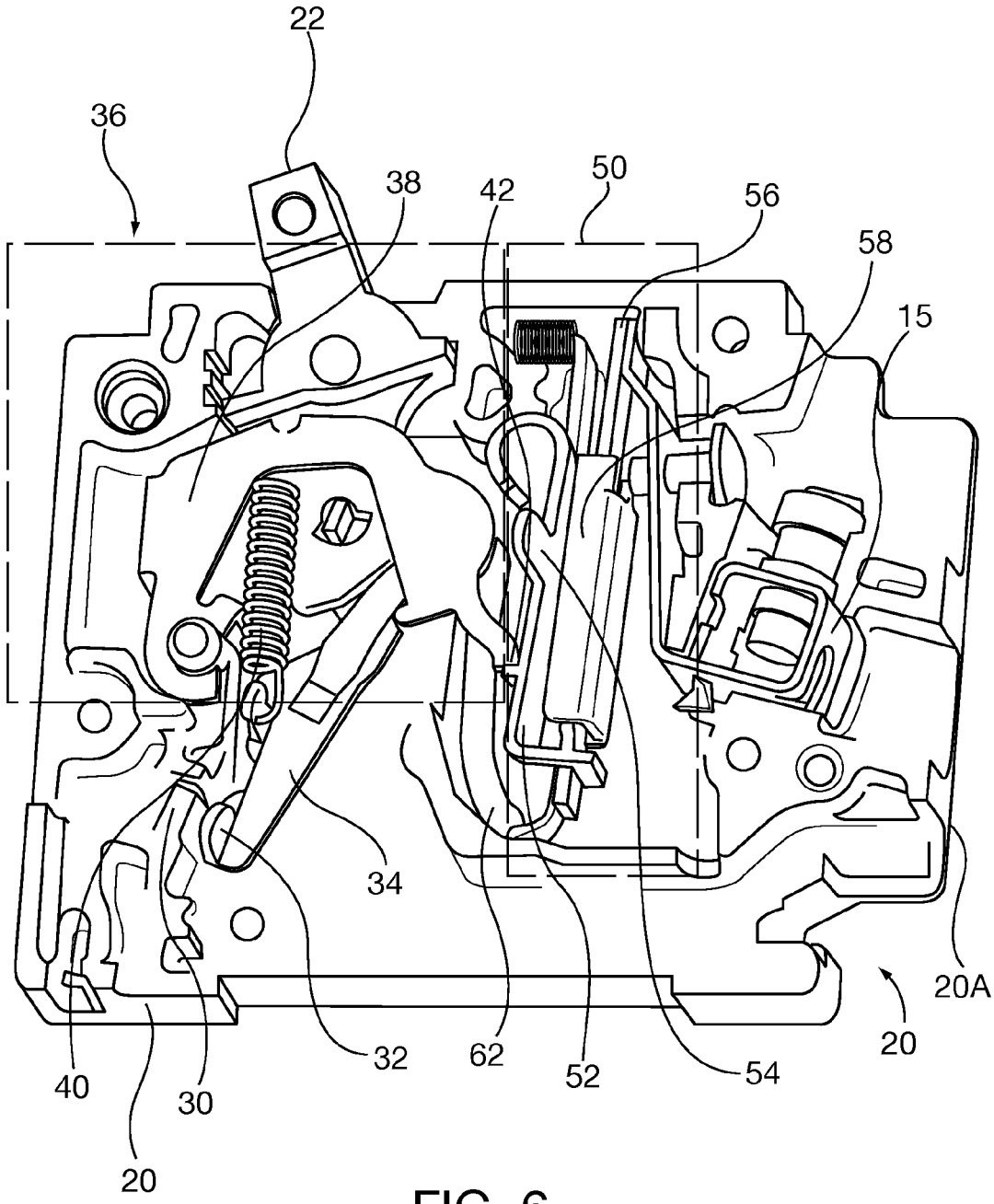
FIG. 6 is a perspective view of a first compartment of a circuit breaker of the present invention.

The general construction of the circuit breaker internal components shown in FIG. 6 are substantially similar to those of the prior art Siemens circuit breaker first compartment described with respect to FIGS. 1 and 2. As will be described in further detail herein, some embodiments of the latch 52 and latch extension 54, as well as the second compartment components of the circuit breaker of the present invention are different than those of the prior art second compartment embodiment shown in FIG. 3. While some of the exemplary circuit breaker embodiments described herein have two separate compartments, it is possible to package the internal components in a single compartment.

FIG. 6 is a perspective plan view of the first compartment of a circuit breaker 10 of the present invention, showing exemplary components housed within the base 20A of housing 20. Note that the intermediate cover 20B is removed in this figure, so that the line terminal 12, fixed contact 30, moving contact 32 and moving contact arm 34 are visible. The operating mechanism 36 includes cradle 38, operating spring 42 and engagement sear 42. The operating mechanism 36 selectively opens and closes the circuit breaker contacts and interacts with the trip unit 52 by engagement of the sear 42 with the pivoting latch 52. As is known to those skilled in the art, latch 52 pivots about a pivoting axis, sweeping a pivotal motion volume. When the engagement sear 42 and latch 52 are engaged the circuit breaker contacts 30, 32 are maintained in the closed position. Conversely, the contacts are open when the latch 52 and engagement sear 42 are disengaged and the circuit breaker 10 does not enable current flow in the power distribution circuit.

The trip unit 50 shown in FIG. 6 includes the latch 52 and latch extension tab 54 that projects laterally from the latch swept volume. As those skilled in the art are aware, the trip unit 50 is of the electromechanical type including overcurrent bimetal 56 that deforms when heated and pivots the latch 52 in counterclockwise fashion to disengage it from the disengagement sear 42. The trip unit also includes an armature assembly 58 that generates a magnetic field attractive to the ferrous metal latch 52. A high current flow through the armature assembly 58 (for example caused by a short circuit in the electrical distribution system) creates a sufficiently dense magnetic flux to pivot the latch 52 in a counterclockwise direction to disengage the operating mechanism sear 42. Calibration screw 60 is used to calibrate the bimetal 56. Braid 62 enables electrical continuity from the trip unit 50 to the moving contact arm 34.

Figure 7:
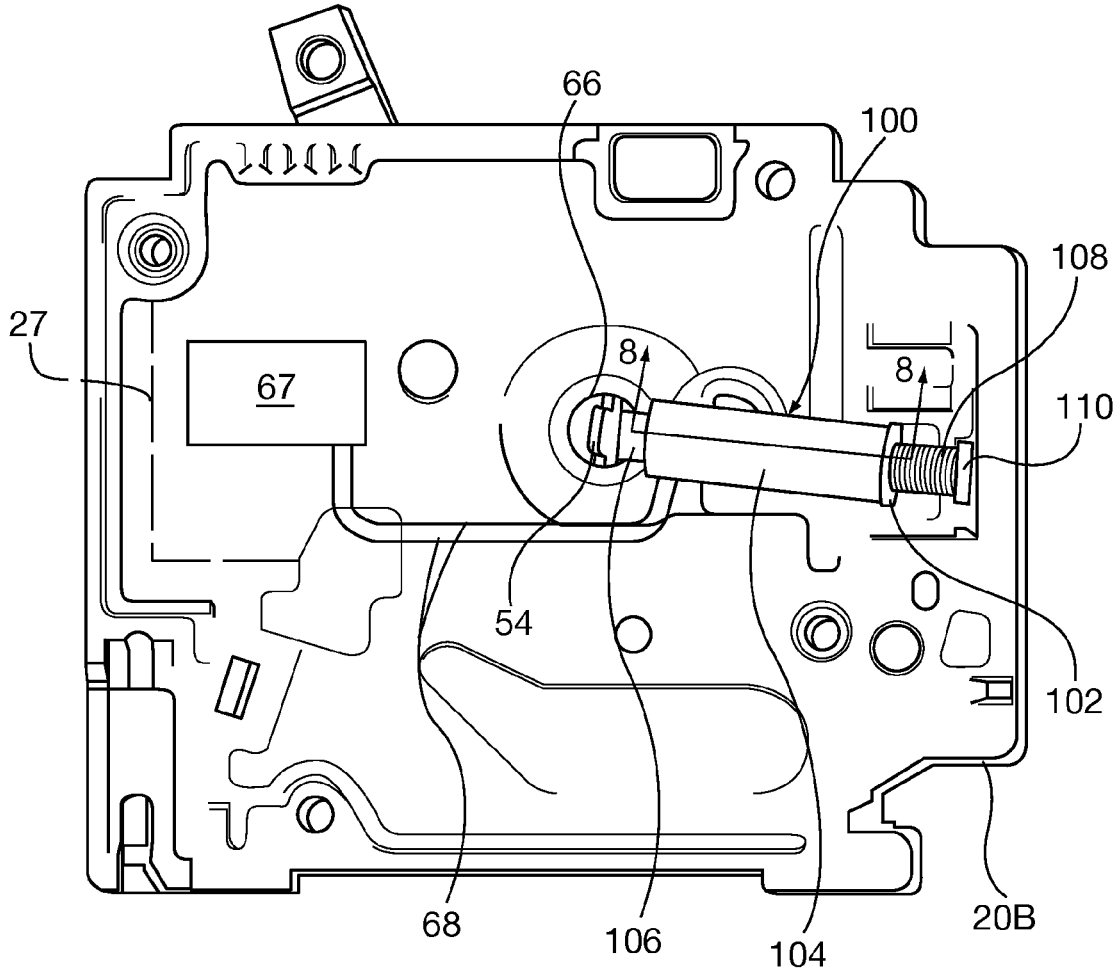
FIG. 7 is a perspective view of a second compartment of a circuit breaker of the present invention.
Figure 8:
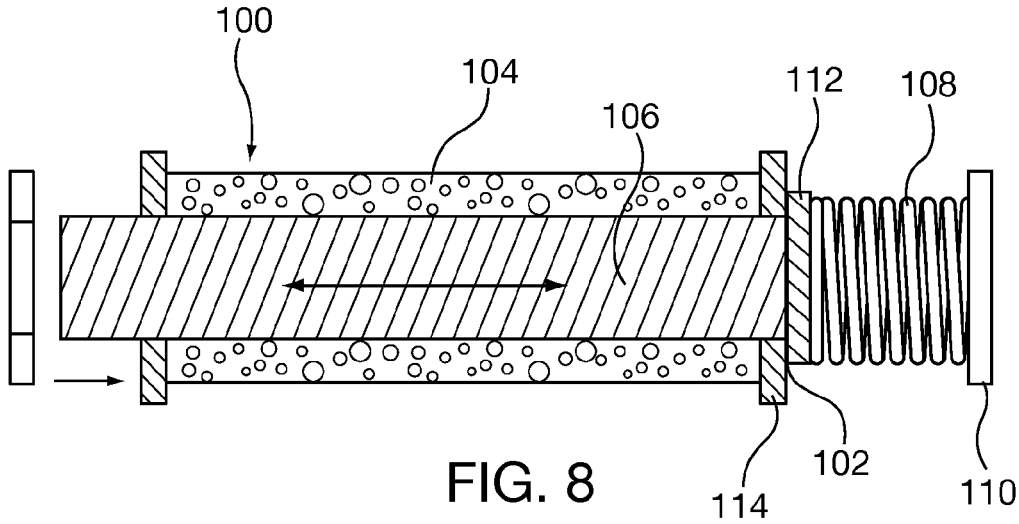
FIG. 8 is a partial cross-sectional plan view of an embodiment of an electromagnet of the present invention.

FIG. 7 is a plan view of the second compartment of the circuit breaker 10 of the present invention showing the intermediate cover 20B; the top cover 20C is removed. Similar to FIG. 2, the latch extension 54 projects from the first compartment into the second compartment through the aperture 66 formed within the intermediate cover 20B. The fault circuit interrupter unit 27 includes the fault detection electronics (examples: arc fault, ground fault or combination of both, parallel overcurrent fault detection, or a remote communication device implementing a command to trip the circuit breaker by way of a communications network coupled to the fault detection electronics), energizing leads 68 and an electromagnet unit 100. The leads 68 are schematically illustrative and as a matter of design choice may constitute wires, bus bars, printed circuit board conductive pathways or any other known structure necessary to transfer power to the electromagnet 100 in this or in any other embodiments of the invention that are described herein. The electromagnet unit 100 attracts (pulls) the latch extension 54 when energized by the fault detection electronics 67, rotating the latch extension counterclockwise and to the right in the figure. This differs significantly from the prior art Siemens circuit breaker design of FIG. 3 that oriented a solenoid 70 on the left side of the latch extension 54 and "pushed" the latch extension to the right. In the prior art design of FIG. 3 the solenoid 70 was clear of the right side of the latch extension 54, giving the latter full freedom of motion to be tripped by the electromechanical trip unit 50. In this manner the electromechanical trip unit 50 and the fault detection electronics 27/electromagnet unit 100 act on a common trip latch 52, yet they operate independently.

Figure 4:
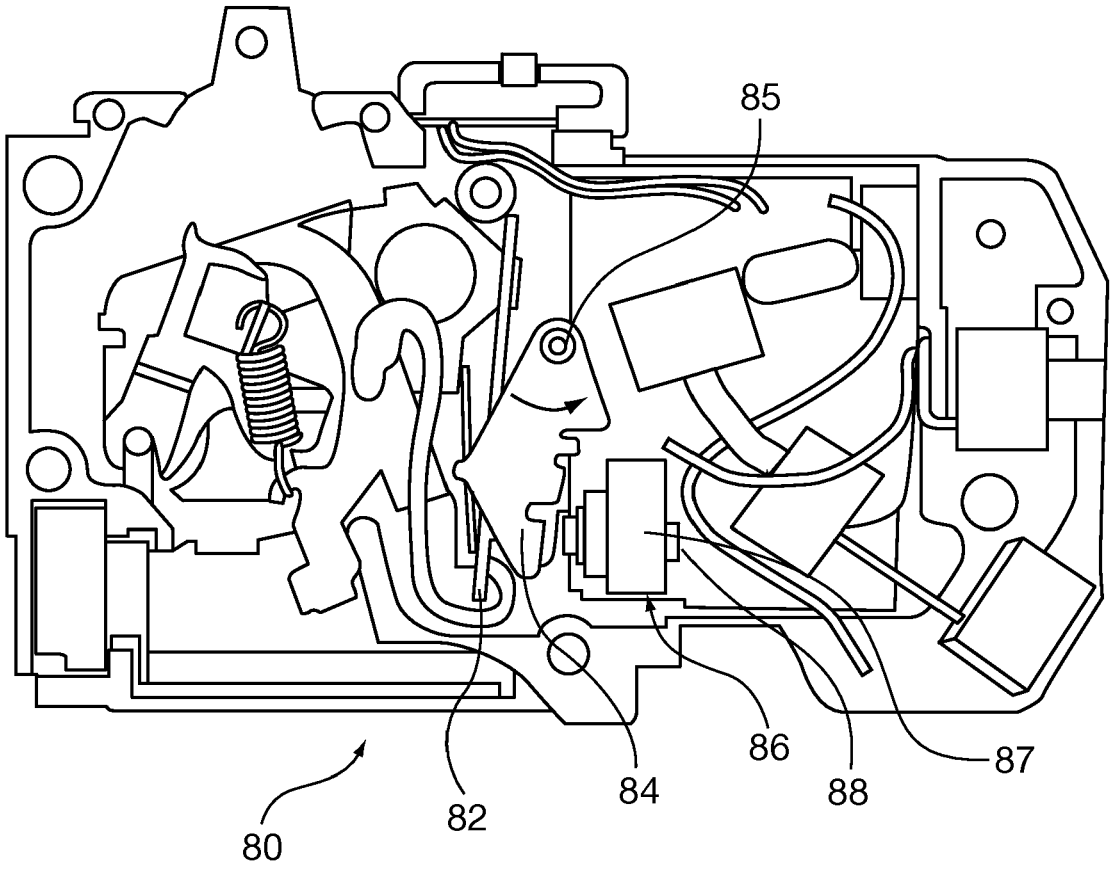
FIG. 4 PRIOR ART
FIG. 4 is a schematic plan view of a second prior art circuit breaker.
Figure 5A:
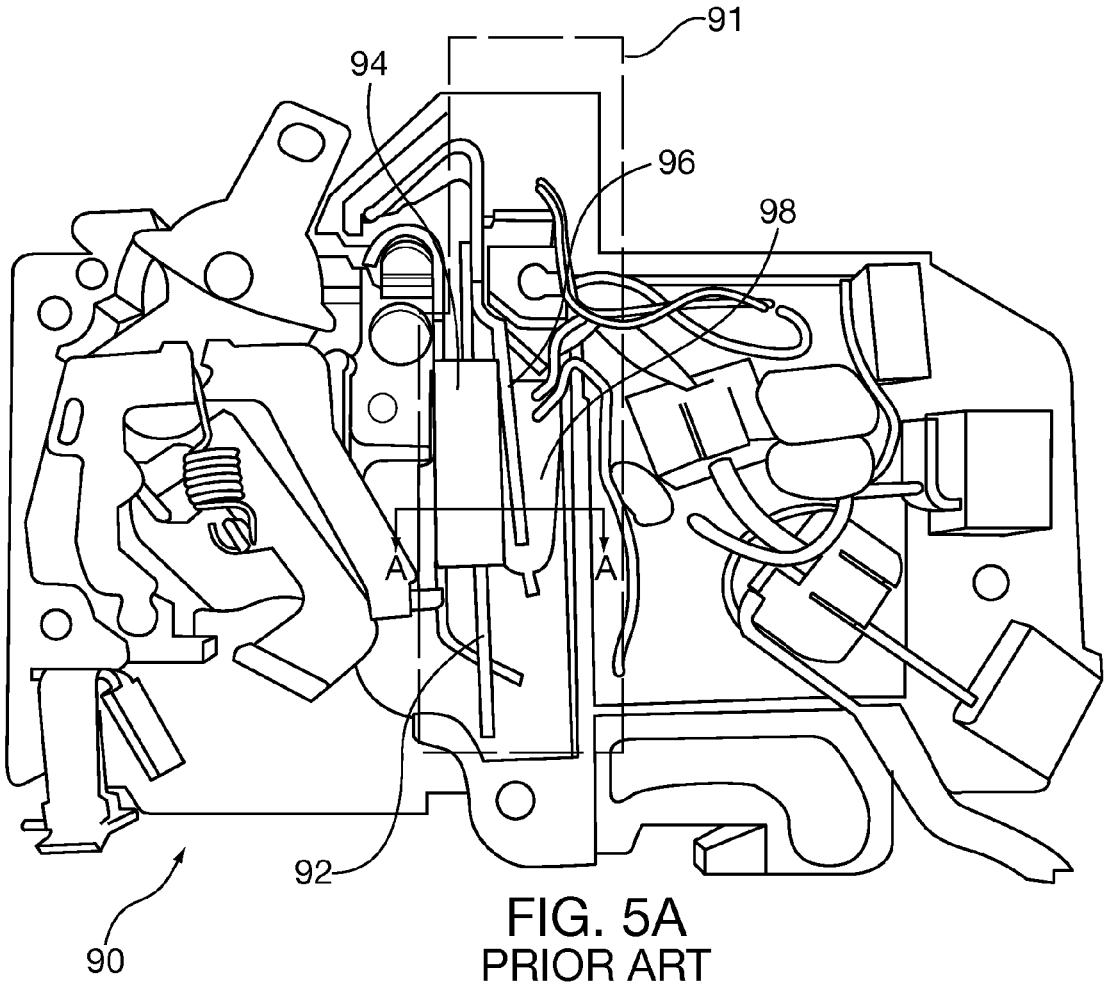
FIG. 5A PRIOR ART
FIGS. 5A and 5B are respectively schematic plan and cross sectional views of a third prior art circuit breaker.
Figure 5B:
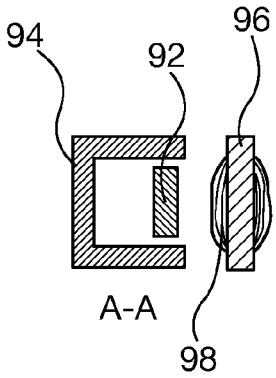
FIG. 5B PRIOR ART

When the latch 52 of the present invention circuit breaker is tripped by the electromechanical trip unit 50, it is caused to rotate counterclockwise (i.e., swing toward the right of FIG. 7). The number of degrees of latch 52/latch extension 54 pivotal arcuate swing may vary as a function of whether the trip is initiated by the bimetal 56 or the armature 58 or the intensity of the overload condition. It is desirable to allow latitude of range of free motion to the latch 52. As was noted with respect to the prior art electromagnet designs shown in FIGS. 4 and 5, increasing free space between the electromagnet and the latch requires a stronger magnet to generate sufficient attractive force to trip the latch, or, alternatively, additional linkage components must be added to the latch. Both are undesirable design tradeoffs that are obviated by the circuit breaker design of the present invention.

Figure 9:
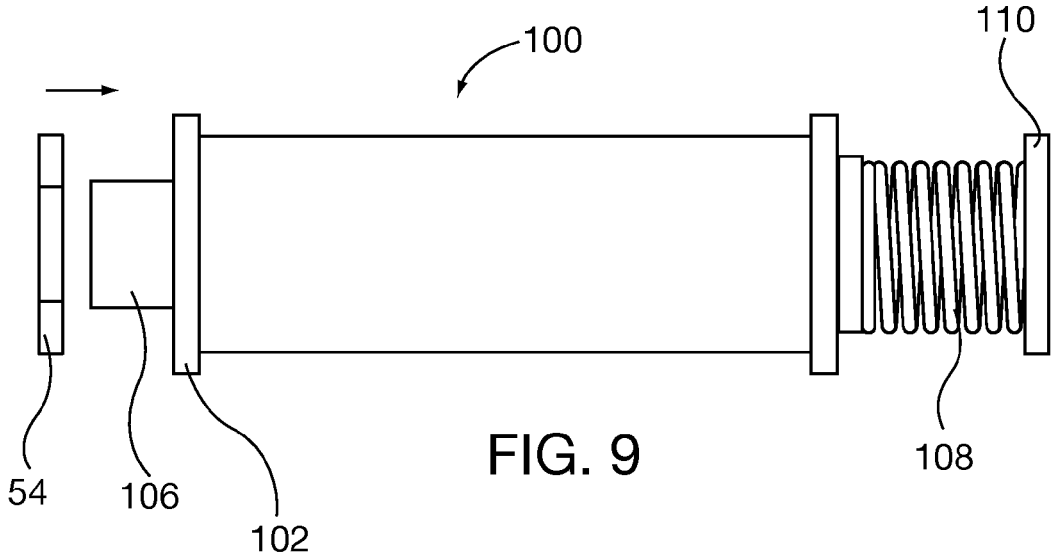
FIGS. 9 and 10 show schematically interaction of the electromagnet of FIG. 8 and latch extension during electromagnet-induced trip initiated by the electronic fault detector unit and overcurrent trip initiated by the electromechanical trip unit, respectively.
Figure 10:
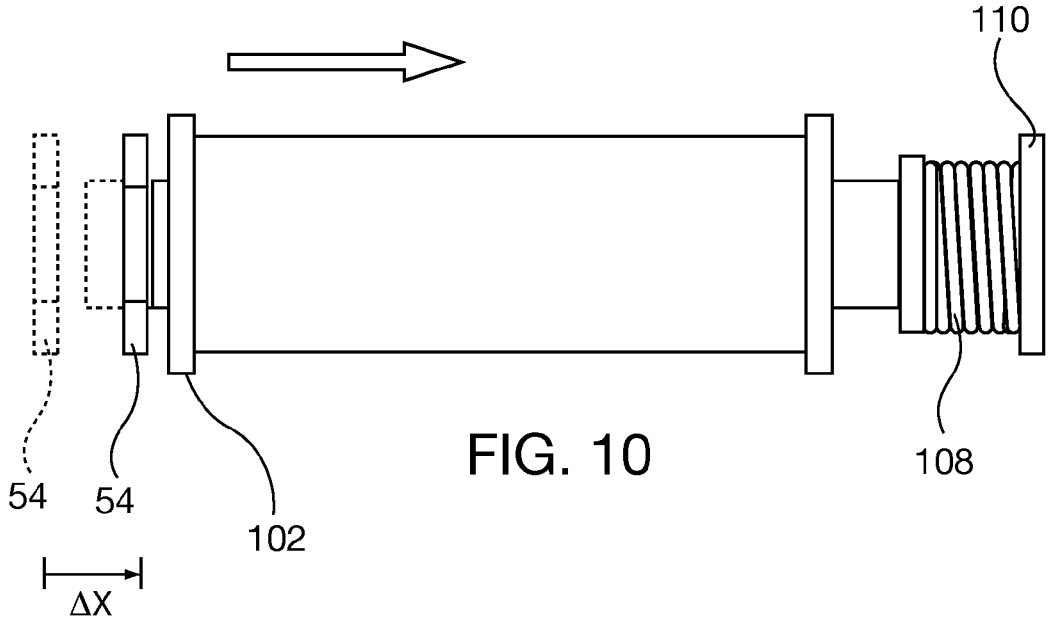

Referring to FIGS. 7-10, the circuit breaker of the present invention facilitates close lateral spacing of the electromagnet 100 and the latch extension tab 54, yet allows the latch extension 54 to have sufficient free sweeping movement space in all operational modes and conditions of the electromechanical trip unit 50. The electromagnet 100 has a bobbin 102 that is affixed to the intermediate cover 20B, and coil windings 104 for generation of a magnetic field upon energization of the windings through the leads 68 that are coupled thereto. A ferromagnetic core 106 is reciprocable within a bore defined by the bobbin 102. As is shown in FIG. 9, the core 106 is closely laterally spaced away from the latch extension 54, thereby minimizing the gap to be bridged by the electromagnetic field that is generated by the electromagnet 100. When the latch 52 and latch extension 54 are tripped by the electromechanical trip unit 50, as shown in FIG. 10, the core 106 is pushed to the right as is necessary to enable sufficient free travel of the latch extension, without potentially damaging the latch or electromagnet 100.

As shown in FIGS. 7-10, the ferromagnetic core 106 may be repositioned back to its initial state proximal the latch extension 54 with a biasing spring 108. The spring 108 is anchored to the circuit breaker intermediate cover 20B by a stop 110, shown schematically. In order to limit reciprocation of the core 106 to the left, it may be constructed with an annular core flange 112 that abuts against an annular face 114 of the bobbin 102. Alternatively, one skilled in the art may choose to construct the ferromagnetic core 106 without the flange 112, instead relying on abutting contact of the core and latch extension 54 to reposition the core back to its initial state.

An alternate embodiment of the present invention is shown in FIGS. 11-13, wherein the latch extension 54 includes bent tab 55 that is aligned generally tangential to the radius of the latch 52 pivoting axis. Electromagnet 120 is oriented outboard of and laterally proximate to the bent tab 55, so that the ferromagnetic core 106 is aligned to attract the latch 52 upon energization of the coil windings 104 by the fault detection electronic unit 67 via the leads 68, as previously described with the embodiment shown in FIG. 7. As shown in FIGS. 12 and 13, when the latch is tripped by the electromechanical overload trip unit, the extension bent tab 55 has sufficient angular ($\Delta\theta$) and lateral left-to-right ($\Delta X$) clearance to pivot past the ferromagnetic core 106 without interference or impact. In this embodiment the electromagnet 120 may have a fixed ferromagnetic core 106, because it is oriented to remain clear of the latch tab 55 through the full range of the latter's pivotal motion in all modes of operation.

Figure 14:
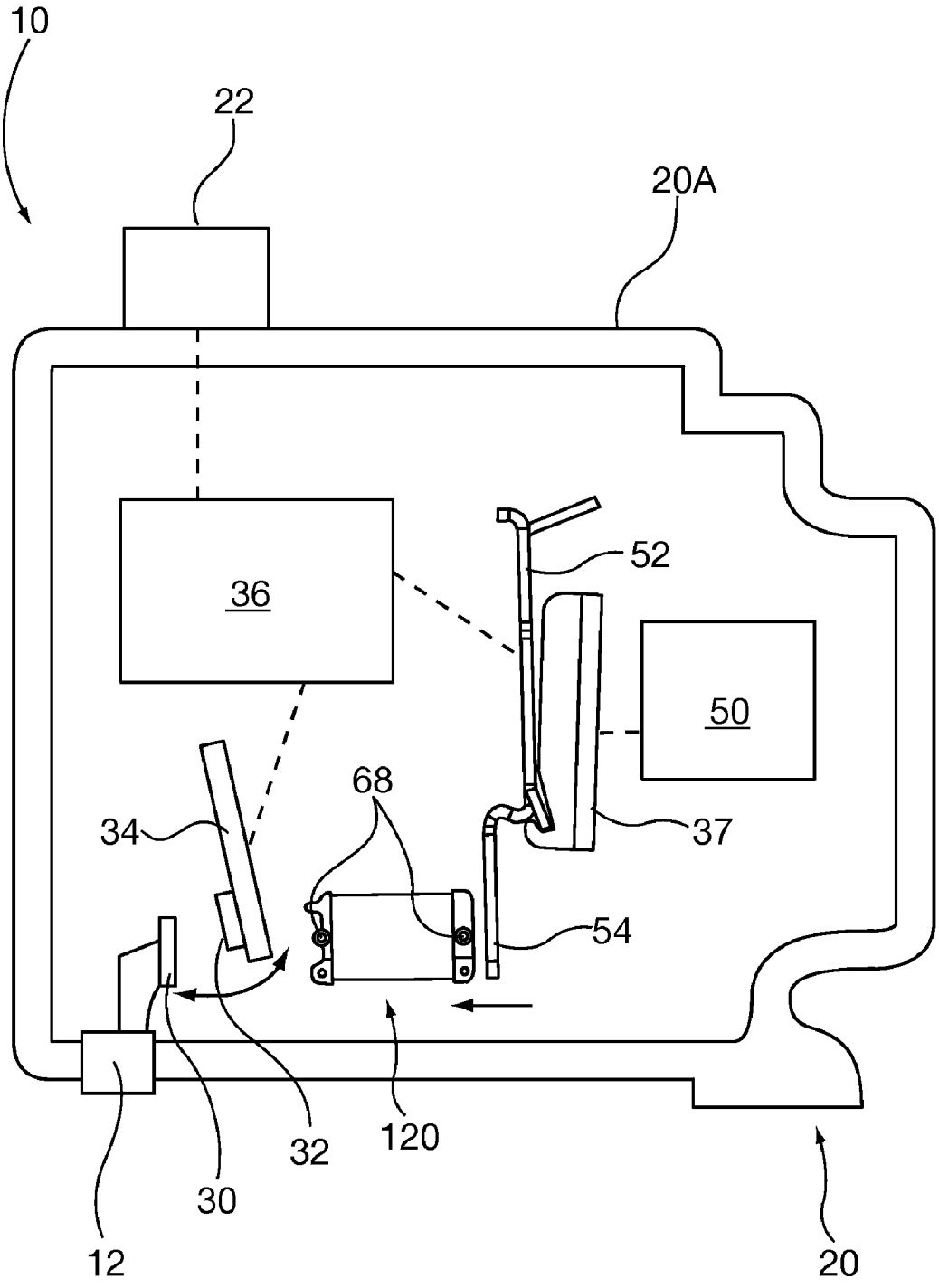
FIG. 14 is a plan view of another embodiment of the electromagnet and latch extension of the present invention, wherein those components are oriented below the trip unit.
Figure 15:
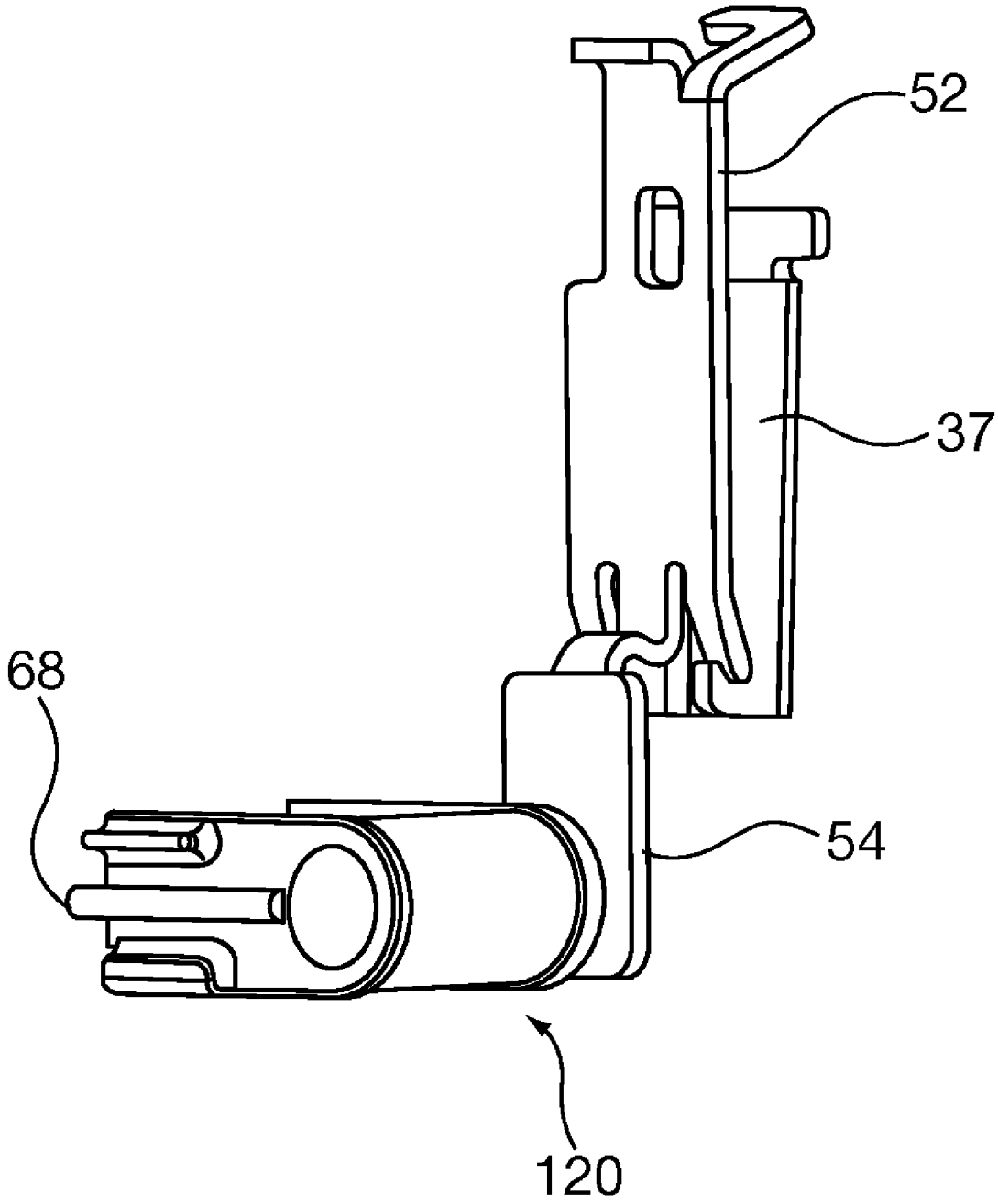
FIG. 15 is a perspective elevation schematic view of the electromagnet and latch extension of FIG. 14 without the surrounding components of the circuit breaker.

FIGS. 14-15 show another alternate embodiment of the present invention, wherein the latch 52 latch extension 54 extends below the trip unit 50 (shown schematically). The electromagnet 120 is oriented below the trip unit outside the pivotal sweep range of the latch extension 54 (clockwise and to the left of the figure), so that the two components do not impact each other during any of the circuit overload trip modes. In this embodiment the latch 52 engages a yoke 37 that is part of the operating mechanism 36 (shown schematically), the interaction of the yoke and the rest of the operating mechanism being understood by those skilled in the art. Other previously described circuit breaker components including the operating handle 22, circuit breaker housing 20, 20A, fixed contact 30, moving contact 32 and moving contact arm 34 are shown schematically.

Figure 16:
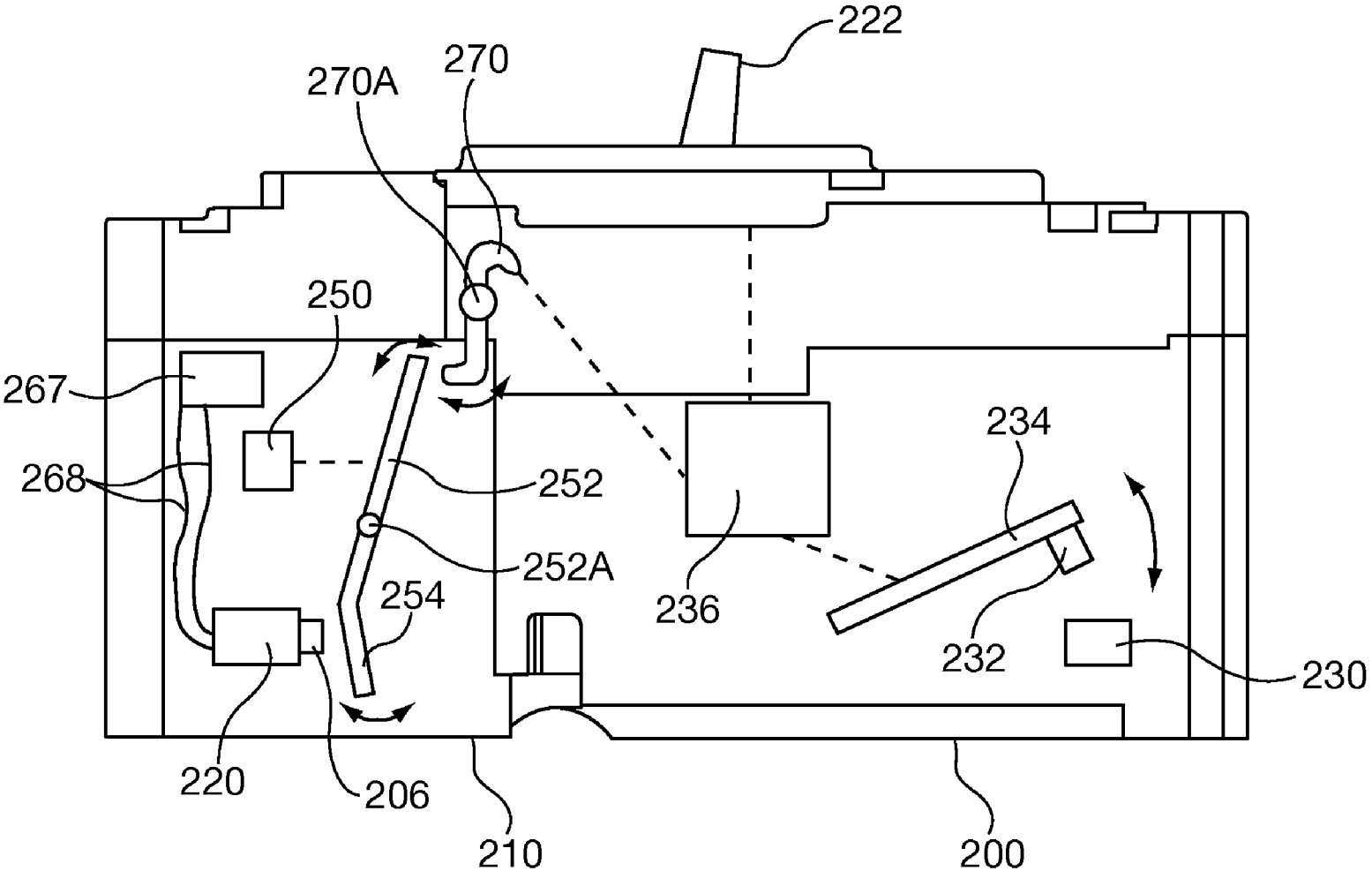
FIG. 16 is a schematic elevation view of an molded case circuit breaker (MCCB) with separate plug-in trip unit incorporating the electromagnet and latch extension of the present invention.
Figure 17:
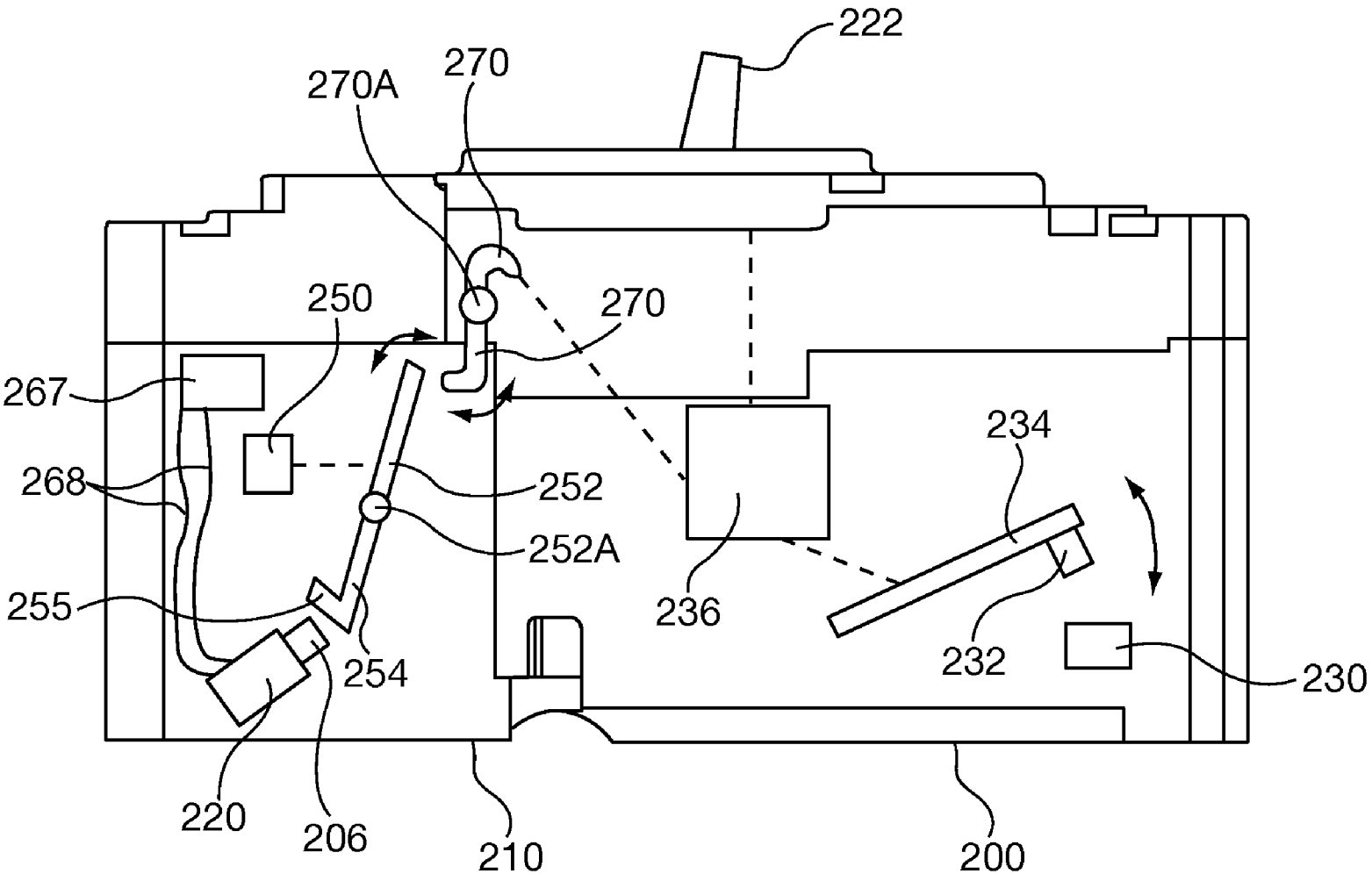
FIG. 17 is a schematic elevation view of an MCCB similar to that of FIG. 16, showing a different embodiment of the electromagnet and latch extension of the present invention.

The present invention can also be applied to various types of circuit breakers that incorporate trip latches. FIGS. 16 and 17 depict schematically application of the present invention within an industrial-type molded case circuit breaker (MCCB) of the type shown and described in U.S. Pat. No. 6,274,833. The MCCB Includes a circuit breaker frame housing 200 that is coupled to a separable trip unit housing 210 so that trip units having different functional capabilities can be interchanged while the MCCB frame housing remains installed in its operating environment, such as a panel board, motor control center or other switchgear. The frame housing 200 includes at least one fixed contact 230, one moving contact 232 and corresponding moving contact arm 234. Pivotal operation of the moving contact arm 234 to control opening and closing of the contacts is performed by the operating mechanism 236. As is known in the art, industrial circuit breakers such as MCCBs often are of multi-phase construction and typically have three phases with three sets of contacts coupled by a common cross bar (not shown) that is coupled to the operating mechanism. Handle 222 can be utilized to open and close the respective contacts 230, 232 as well as reset the circuit breaker after a fault trip. A generally S- or bell crank-shaped trip bar 270 that pivots about axis 270A is an intermediate linkage member in the trip mechanism. In this exemplary MCCB embodiment, counter clockwise pivoting of the trip bar 270 causes the operating mechanism to release the contact arm(s) 234 to a contacts open position.

The removable trip unit housing 210 includes an short circuit/over current trip unit 250 that pivots the latch 252 about its pivoting axis 252A that in turns pivots the trip bar 270 upon detection of a fault condition. The trip unit 250 may be electromechanical with thermal magnetic trip mechanisms previously discussed or it may be a purely electronic trip unit. The latch 252 includes a latch extension 254 that is attracted by electromagnet 220 when the electromagnet is energized by an electronic fault detector 267 through energizing leads 268. The fault detector 267 as previously described may detect faults such as ground faults or arc faults. The electromagnet 220 is oriented outside the full range of pivoting motion of the latch 252 and its extension 254, so as to assure that those respective components do not impact during any trip mode of circuit breaker operation. The electromagnet may have a fixed core construction of the type shown and described with reference to FIG. 10 or a reciprocating core construction of the type shown and described with respect to FIGS. 8-10. As shown in FIG. 17, the latch extension 254 includes bent tab 255 that is aligned generally tangential to the radius of the latch 252 pivoting axis. Electromagnet 220 is oriented outboard of and laterally proximate to the bent tab 255, so that the ferromagnetic core 206 is aligned to attract the latch 252 upon energization of the coil windings by the fault detection electronic unit 267 via the leads 268, as previously described with the embodiment shown in FIG. 7. The electromagnet 220 may have a fixed ferromagnetic core 206, because it is oriented to remain clear of the latch tab 255 through the full range of the latter's pivotal motion in all modes of operation.

In summary, the circuit breaker of the present invention utilizes parallel electronic fault detection and electromechanical fault detection through actuation of a common latch mechanism interface with the circuit breaker contacts operating mechanism. The latch interface for the electronic fault detector is an electromagnet that directly attracts the latch.

Although various embodiments which incorporate the teachings of the present invention have been shown and described in detail herein, those skilled in the art can readily devise many other varied embodiments that still incorporate these teachings.

What is claimed is:

1. A circuit breaker for electrical power distribution circuits, comprising:

a housing including therein:

a pair of separable contacts for selectively opening and closing an electrical power distribution circuit current flow when the contacts are in respective opened and closed positions, an operating mechanism coupled to the contacts for selectively opening and closing the contacts, an overload trip unit, occupying a volume within the housing, for detecting overload conditions in an electrical power distribution circuit, having a moveable latch, the latch engageable with the operating mechanism, wherein the contacts are maintained in the closed position when the latch is engaged with the operating mechanism and the contacts are open when the latch is disengaged from the operating mechanism, the trip unit disengaging the latch upon detection of an overload condition, an electromagnet unit oriented in the housing proximal the latch without any components interposed therebetween, the electromagnet directly attracting the latch and disengaging the latch when the windings are energized, the electromagnet having: a bobbin attached to the housing with windings oriented thereabout, a reciprocating ferromagnetic core oriented within the bobbin, the core oriented proximal and laterally spaced away from the latch and reciprocated by the latch when the latch is disengaged by the overload trip unit, and a fault interruption unit for detecting fault conditions in an electrical power distribution circuit, electrically coupled to the electromagnet windings, the interruption unit energizing the electromagnet unit upon detection of a fault condition.

2. The circuit breaker of claim 1, wherein the electromagnet unit further comprises a resetting biasing element, coupled to the reciprocating ferromagnetic core to restore the core to its original orientation proximal the latch after latch disengagement by the overload trip unit.

3. The circuit breaker of claim 1, wherein the housing further comprises at least a pair of first and second compartments defining an inter-compartment aperture there between, the first compartment including therein the separable contacts, operating mechanism and overload trip unit, and the second compartment including therein the electromagnet and fault detection units.

4. The circuit breaker of claim 1, wherein the electromagnet unit is oriented outside of the trip unit occupied volume.

5. A circuit breaker for electrical power distribution circuits, comprising:

a housing including therein:

a pair of separable contacts for selectively opening and closing an electrical power distribution circuit current flow when the contacts are in respective opened and closed positions, an operating mechanism coupled to the contacts for selectively opening and closing the contacts, an overload trip unit for detecting short circuit and thermal overheating overload conditions in an electrical power distribution circuit, having a pivotal latch defining a latch face that sweeps a sector-shaped pivotal motion volume and a latch extension coupled to the latch face and projecting outside of the pivotal motion volume, the latch engageable with the operating mechanism, wherein the contacts are maintained in the closed position when the latch is engaged with the operating mechanism and the contacts are open when the latch is disengaged from the operating mechanism, the trip unit disengaging the latch upon detection, of an overload condition, an electromagnet unit, isolated from the trip unit, having windings, oriented in the housing laterally offset from the latch face and its swept volume, said electromagnet unit proximal the latch extension without any components interposed there between, the electromagnet directly attracting the latch extension and disengaging the latch when the windings are energized, and a fault interruption unit, operatively independent from the trip unit, for detecting fault conditions in an electrical power distribution circuit, electrically coupled to the electromagnet windings, the interruption unit energizing the electromagnet unit upon detection of a fault condition.

6. The circuit breaker of claim 5, wherein the electromagnet unit further comprises a bobbin attached to the housing and the windings are oriented about the bobbin.

7. The circuit breaker of claim 6, wherein the electromagnet unit further comprises a reciprocating ferromagnetic core oriented within the bobbin, the core oriented proximal and laterally spaced away from the latch extension and reciprocated by the latch extension when the latch is disengaged by the overload trip unit.

8. The circuit breaker of claim 7, wherein the electromagnet unit further comprises a resetting biasing element coupled to the reciprocating ferromagnetic core to restore the core to its original orientation proximal the latch extension after latch disengagement by the overload trip unit.

9. The circuit breaker of claim 5, wherein the housing further comprises at least a pair of first and second compartments defining an inter-compartment aperture there between, the first compartment including therein the separable contacts, operating mechanism and overload trip unit, and the second compartment including therein the electromagnet and fault detection units.

10. A circuit breaker for electrical power distribution circuits, comprising:

a housing having at least a pair of first and second compartments defining an inter-compartment aperture there between, the first compartment including therein:

a pair of separable contacts for selectively opening and closing an electrical power distribution circuit, current flow when the contacts are in respective opened and closed positions, an operating mechanism coupled to the contacts for selectively opening and closing the contacts, an overload trip unit for detecting overload conditions in an electrical power distribution circuit, having a moveable latch and a latch extension coupled to the latch, the latch engageable with the operating mechanism, wherein the contacts are maintained in the closed position when the latch is engaged with the operating mechanism and the contacts are open when the latch is disengaged from the operating mechanism, the trip unit disengaging the latch upon detection of an overload condition;

the second compartment including therein:

an electromagnet unit having windings, oriented proximal the latch extension, the electromagnet attracting the latch extension and disengaging the latch when the windings are energized, and a fault interruption unit for detecting fault conditions in an electrical power distribution circuit, electrically coupled to the electromagnet windings, the interruption unit energizing the electromagnet unit upon detection of a fault condition.

11. The circuit breaker of claim 10, wherein the electromagnet unit further comprises a bobbin attached to the housing and the windings are oriented about the bobbin.

12. The circuit breaker of claim 11, wherein the electromagnet unit further comprises a reciprocating ferromagnetic core oriented within the bobbin, the core oriented proximal and laterally spaced away from the latch extension, and reciprocated by the latch extension when the latch is disengaged by the overload trip unit.

13. The circuit breaker of claim 12, wherein the electromagnet unit further comprises a resetting biasing element coupled to the reciprocating ferromagnetic core to restore the core to its original orientation proximal the latch extension after latch disengagement by the overload trip unit.

14. A circuit breaker for electrical power distribution circuits, comprising:

a housing including therein:

a pair of separable contacts for selectively opening and closing an electrical power distribution circuit current flow when the contacts are in respective opened and closed positions, an operating mechanism coupled to the contacts for selectively opening and closing the contacts, an overload trip unit for detecting overload conditions in an electrical power distribution circuit, having a pivotal latch defining a pivot axis and radius, the latch further defining a latch face that upon actuation sweeps a sector-shaped pivotal motion volume, a latch extension attached to and projecting outwardly from the latch face, the latch extension sweeping upon actuation an arcuate motion path and a pivotal motion volume that defines inner and outer radii and generally oriented normally thereto, at least a portion of the latch extension projecting generally tangentially to the pivot radius, normal to the latch face, the latch engageable with the operating mechanism, wherein the contacts are maintained in the closed position when the latched is engaged with the operating mechanism and the contacts are open when the latch is disengaged from the operating mechanism, the trip unit disengaging the latch upon detection of an overload condition, an electromagnet unit having windings, oriented in the housing laterally offset from the latch face and its swept volume, and spaced radially offset away from the tangential portion of the latch extension and its pivotal motion volume defined by said inner and outer radii, the electromagnet directly attracting the tangential portion of the latch extension and disengaging the latch when the windings are energized, and a fault interruption unit for detecting fault conditions in an electrical power distribution circuit, electrically coupled to the electromagnet windings, the interruption unit energizing the electromagnet unit upon detection of a fault condition.

15. The circuit breaker of claim 14, wherein the electromagnet unit further comprises a bobbin attached to the housing and the windings are oriented about the bobbin.

16. The circuit breaker of claim 15, wherein the electromagnet unit further comprises a ferromagnetic core within the bobbin, the core oriented proximal to and laterally spaced away from the tangential portion of the latch extension.

17. The circuit breaker of claim 14, wherein the housing further comprises at least a pair of first and second compartments defining an inter-compartment aperture there between, the first compartment including therein the separable contacts, operating mechanism and overload trip unit, and the second compartment including therein the electromagnet and fault detection units.

18. The circuit breaker of claim 17, wherein the latch extension projects through the inter-compartment aperture into the second compartment.

* * * * *